US007320611B2

(12) United States Patent
Abbott

(10) Patent No.: US 7,320,611 B2
(45) Date of Patent: Jan. 22, 2008

(54) TERMINATOR LOCKING DEVICE

(76) Inventor: Phillip G. Abbott, 819 Mimosa Heights Dr., Louisville, TN (US) 37777

( * ) Notice: Subject to any disclaimer, the term of this patent is extended or adjusted under 35 U.S.C. 154(b) by 0 days.

(21) Appl. No.: 11/499,932

(22) Filed: Aug. 7, 2006

(65) Prior Publication Data

US 2007/0020977 A1 Jan. 25, 2007

Related U.S. Application Data

(63) Continuation-in-part of application No. 11/186,050, filed on Jul. 21, 2005, now Pat. No. 7,086,877.

(51) Int. Cl.
*H01R 13/44* (2006.01)

(52) U.S. Cl. ..... 439/133; 439/307

(58) Field of Classification Search ..... 439/133, 439/131, 132, 134, 307
See application file for complete search history.

(56) References Cited

U.S. PATENT DOCUMENTS 3,027,535 A 3/1962 Persson
3,519,979 A 7/1970 Bodenstein
4,824,386 A 4/1989 Souders
4,932,874 A 6/1990 Hollopeter et al.
5,106,312 A 4/1992 Yeh
5,395,348 A 3/1995 Ryan
5,435,736 A 7/1995 McMills et al.
5,564,938 A * 10/1996 Shenkal et al. ..... 439/301

* cited by examiner

*Primary Examiner*—Michael C. Zarroli
(74) *Attorney, Agent, or Firm*—Pitts & Brittian, P.C.

(57) ABSTRACT

A terminal locking system comprises an elongated tubular case having a connection end section and an opposing distal end section, an adapter, configured to matingly engage a terminal, rotatably mounted within said connection end section and including an engagement surface located within said case, and a blocker, comprising a disk having at least one aperture extending through said disk, mounted within said tubular case between said engagement surface and said distal end.

13 Claims, 8 Drawing Sheets

TERMINATOR LOCKING DEVICE

CROSS-REFERENCE TO RELATED APPLICATIONS

This application is a Continuation-In-Part of U.S. application Ser. No. 11/186,050, filed Jul. 21, 2005 now U.S. Pat. No. 7,086,877.

STATEMENT REGARDING FEDERALLY SPONSORED RESEARCH OR DEVELOPMENT

Not Applicable

BACKGROUND OF THE INVENTION

1. Field of Invention

This invention pertains to caps for radio frequency terminators having threaded connectors.

More particularly, this invention pertains to a tamper-proof locking device and related tools for locking and unlocking the device.

2. Description of the Related Art

In the field of radio frequency signal distribution over a conducting cable, for example cable television, an incoming cable, called a "drop," is generally threadably connected to a terminal or splitter from which the signal is then distributed to a plurality of locations. There are times when the incoming cable must be terminated in a manner that prevents accessibility to the signal carried on the cable. This may occur when a cable system is installed, before a licensed user is available to use the signal. Alternatively, it may be necessary when a licensed user fails to make payments to the signal provider so that service must be terminated.

In the prior art, a 75 ohm resistor adapter having a male connector and a female connector is threadably attached to the terminal using the female connector and the drop is threadably connected to the male connector. The resistor prevents communication of the signal to the terminal. However, because unlicensed users have removed the resistor adapters without permission, in order to use the service without payment, the resistor adapters have been modified to resist removal without a particular tool.

In one prior art device, the female connector is rotatably mounted within a sleeve that includes the male connector. Thus, when the resistor adapter is tightly secured to the terminal, the sleeve rotates freely and the adapter is not readily removable from the terminal.

The male connector is tubular in shape to allow insertion of a tool comprising a female connector adapted to threadably engage the male connector of the resistor adapter and an axial extension. By tightening the engagement of the female connector of the tool with the male connector of the resistor adapter, the axial extension of the tool extends through the sleeve to frictionally engage the smooth outer surface of the female connector and prevent rotation of the female connector relative to the sleeve. In this condition, with the tool securely attached, the resistor adapter can be either attached or removed from the terminal.

Unfortunately, there are still users who have found methods for improperly removing the resistor adapters in order to acquire unauthorized access to the signal carried on the drop cable. For example, some users use a nail or drill to pierce the female connector of the resistor adapter and thereby control the rotation of the female connector and remove it from the terminal.

Accordingly there remains a need to prevent the unauthorized removal of resistor adapters from radio frequency terminals.

BRIEF SUMMARY OF THE INVENTION

According to one embodiment of the present invention, a system is provided for preventing unauthorized removal of resistor adapters from radio frequency terminals. Generally, a resistor adapter, including a female connector rotatably mounted within a sleeve including an opposing coaxial male connector, is secured within a tubular case having an inner diameter. The sleeve is secured within the tubular case to prevent rotation of the sleeve relative to the case. Preferably, the tubular case is constructed from hardened steel to prevent easy destruction, by cutting, for example. The case is cylindrically tubular to allow insertion of a first blocker tool comprising a female connector adapted to threadably engage the male connector of the resistor adapter.

An elongated blocker, having a female end section and an opposing male end section is mounted within the case to prevent access to the female connector of the resistor adapter through the case. The female end section is rotatable relative to the male end section and coaxial therewith. The female end section includes a non-cylindrical exterior shoulder. The width of the blocker is less than the inner diameter of the case to permit insertion of a first blocker tool to engage the non-cylindrical shoulder of the female end section and rotate the female end section relative to the male connector of the resistor adapter.

An extension portion of the male end section extends longitudinally from the case. The extension portion includes a non circular engagement surface adapted to be engaged by a second blocker tool. The distal end of the male end section of the blocker is preferably conically shaped and constructed from hardened steel to prevent damage or removal to gain access to the female end section. An elongated cap, preferably comprising hardened steel, includes a female connector and an opposing male connector. The female connector of the cap is threadably connectable to the male end section of the blocker.

In this embodiment, spacer lugs are included in the end wall of the case to prevent complete engagement of the case and the cap. The spacer lugs permit insertion of a second blocker tool between the case and the cap to engage the engagement surface of the male end section of the blocker and prevent rotation of the male end section of the blocker while the cap is threadably attached to or removed from the blocker.

According to another embodiment of the present invention, a resistor adapter, including a female connector section and an opposing engagement surface, is rotatably mounted within a connection end of a case including an opposing coaxial male connector. The sleeve is rotatably mounted within the tubular case to allow rotation of the sleeve relative to the case. Preferably, the tubular case is constructed from hardened steel to prevent easy destruction, by cutting, for example. The case is cylindrically tubular to allow insertion of a blocker tool between the resistor adapter and the male connector. The blocker comprises a disk section and a coaxial stem section which extends coaxially into the male connector. At least one aperture extends through the disk section of the blocker to allow insertion of a tool to frictionally engage the engagement surface of the resistor adapter. The tool is releasably secured to the case, whereby the tool, the case and the resistor adapter are prevented from rotating relative to one another when the terminating locking cover is attached or removed from a terminator.

According to still another embodiment of the present invention, a resistor adapter, including a female connector section and an opposing engagement surface, is rotatably mounted within a case having a connection end section and an opposing distal end. The sleeve is rotatably mounted within the tubular case to allow rotation of the sleeve relative to the case. Preferably, the tubular case is constructed from hardened steel to prevent easy destruction, by cutting, for example. The case is cylindrically tubular to allow insertion of a blocker tool between the resistor adapter and the distal end. The blocker comprises a disk section and a coaxial stem section which extends coaxially through the distal end of the case. A threaded bushing is coaxially and rotatably mounted upon the stem. A cap, comprising a disk and a coaxial stem, is secured to the stem of the blocker to prevent removal of the threaded bushing from the stem of the blocker.

At least one aperture extends through the disk section of the blocker to allow insertion of a tool to frictionally engage the engagement surface of the resistor adapter. The tool is releasably secured to the case, whereby the tool, the case and the resistor adapter are prevented from rotating relative to one another when the terminating locking cover is attached or removed from a terminator.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
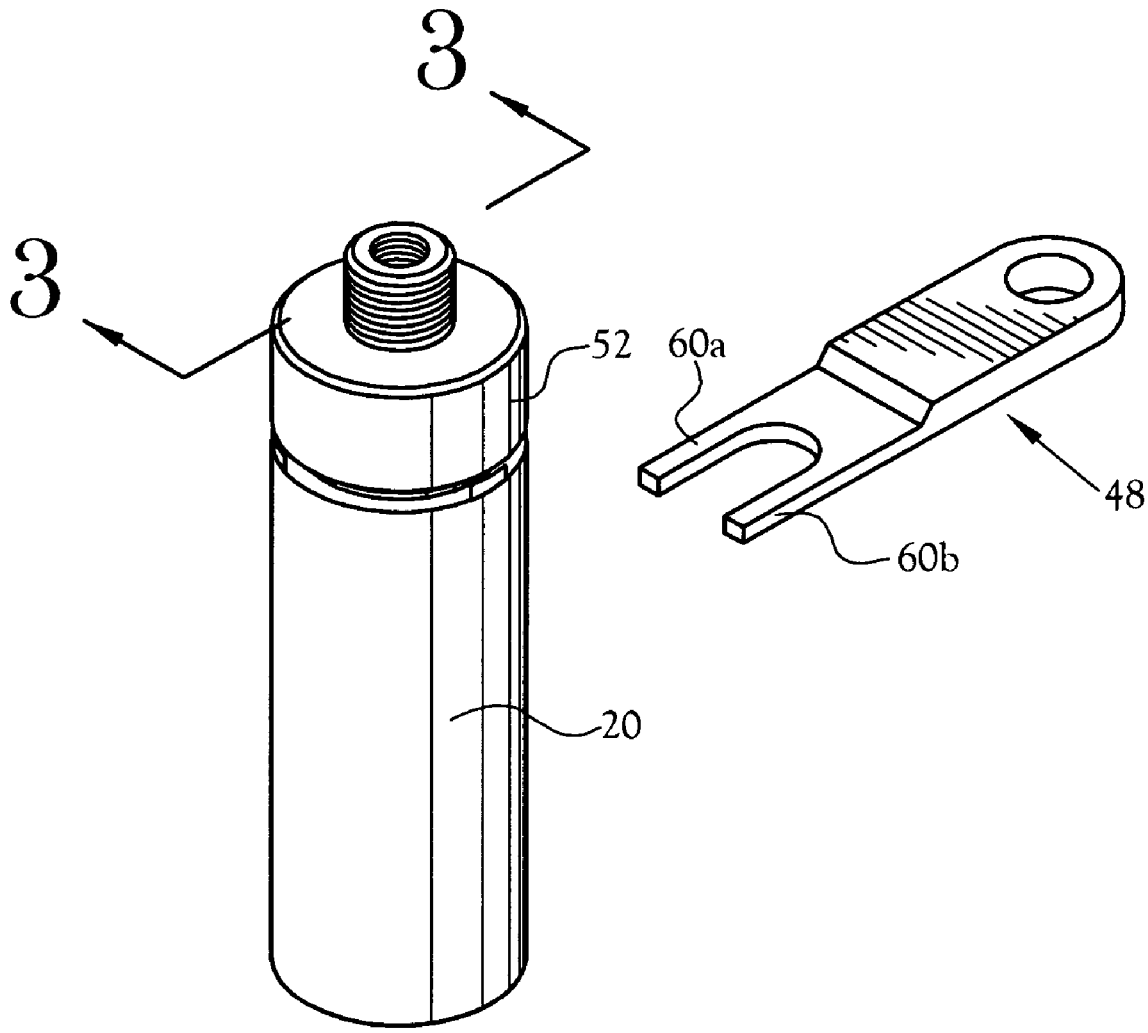
FIG. 1 is a perspective view of an embodiment of a terminator locking system in accordance with the present invention.

Referring to the drawings, in which similarly numbered items represent similar items, a system, including a protective cover for a resistor adapter and tools for assembling and disassembling the cover, is disclosed.

Generally, a resistor adapter 10, including a female connector 12 adapted for mating engagement with a terminal is rotatably mounted within a sleeve 16 including an opposing coaxial male connector 18, is secured within an elongated tubular case 20 having an inner diameter. The tubular case 20 includes a connection end 22 and a protection end 24. The distal end 26 of the female connector 12 is generally coplanar with the connection end of the case 20 so that when the female adapter 12 is fully engaged with the terminal 14 it is fully surrounded by the case 20 and the terminal 14. The sleeve 16 is secured within the tubular case by a pressure fit to prevent rotation of the sleeve 16 relative to the case 20. Other means may be used to prevent rotation of the sleeve 16 relative to the case 20. Preferably, the tubular case 20 is constructed from hardened steel to prevent easy destruction, by cutting, for example.

The case 20 is cylindrically tubular to allow insertion of a first end 28 of an elongated first blocker tool 30. The first end 28 is tubular and threaded to matingly engage the male connector 18 of the resistor adapter 10. An axial extension 32 extends beyond the first end 28 so that, when the first end 29 is fully engaged with the male connector 18, the extension makes pressurized contact with the female adapter 12. In this manner the female adapter 12 is rotatable for attachment and removal from the terminal 14.

A removable elongated blocker 34, having a female end section 36 and an opposing male end section 38 is mounted within the case to prevent access to the female connector 12 of the resistor adapter 10 through the case 20. The female end section 36 is rotatable relative to the male end section 38 and coaxial therewith. The female end section 36 includes a non-cylindrical exterior shoulder 40. The diameter of the blocker 34 is less than the inner diameter of the case 20 to permit insertion of a second end 42 of the first blocker tool 30 to engage the non-cylindrical shoulder 42 of the female end section 36 and rotate the female end section 36 relative to the male connector 18 of the resistor adapter 10.

An extension portion 44 of the male end section 38 extends longitudinally from the case 20 when the female end section 36 is fully engaged with the male connector 18. The extension portion 44 includes a non circular engagement surface 46 adapted to be engaged by a second blocker tool 48. The distal end 50 of the male end section 38 of the blocker 34 is preferably conically shaped and constructed from hardened steel to prevent damage or removal to gain access to the female end section 36.

An elongated cap 52, preferably comprising hardened steel, includes a female end section 54 and an opposing male end section 56. The female end section 54 of the cap 52 is threaded for mating connection to the male end section 38 of the blocker 34. The male end section 56 of the cap 52 is threaded for mating engagement with a coaxial cable transmitting a signal from the terminal to an end user.

In this embodiment, spacer lugs 58 are included in the protection end of the case 20 to prevent complete engagement of the protection end 24 of the sleeve 20 sleeve and the cap 52 when they are matingly engaged. The spacer lugs permit insertion of two parallel tines 60*a* and 60*b* of the second blocker tool 48 between the case 20 and the cap 52 to engage the engagement surface 46 of the male end section 38 of the blocker 34 and prevent rotation of the male end section of the blocker while the cap 52 is threadably attached to or removed from the blocker.

In operation, a cable for which service is being terminated is removed from the terminal 14, exposing the male connector 62. The first end 28 of the first blocker tool 30 is inserted into the case 20 and rotated to threadably engage the male connector 18 of the resistor adapter 10. Upon full mating engagement of the first end 28 with the male connector 18, the axial extension provides sufficient pressure against the female adapter 12 to prevent rotation of the female adapter 12 relative to the male connector 18 and the female adapter is threadably mounted upon the male connector of the terminal 14 and tightened until the connection end 22 of the case 20 contacts the terminal 14. The first blocker tool 30 is then unthreaded from the male connector 18 and removed from the case 20. At this point, the female adapter 12 is securely attached to the male connector 62 of the terminal 14 and the case 20 is freely rotatable relative to the female adapter 12.

The female end section 36 of the blocker 34 is inserted into the case 20 and threaded onto the male connector 18. The second end 42 of the first blocker tool 30 matingly engages the shoulder 40 so that rotation of the first blocker tool 30 tightens the engagement between the male connector 18 and the female end section 36 of the blocker 34. At this point, the case 20 is freely rotatable relative to both the female adapter 12 and the male end section 38 of the blocker 34.

The female end section 54 of the cap 52 is then attached to the blocker by threading onto the male end section 38 of the blocker 34. The tines 60*a* and 60*b* of the second blocker tool 48 are then inserted between the space lugs 58 to engage the non-circular engagement surface 46 and prevent rotation of the male end section 38 while the cap is tightened onto the male section 38. The tightening may be accomplished by re-attaching the service cable to the male end section 56 of the cap 52, for example. Then the second blocker tool is withdrawn. At this point, the case 20 is freely rotatable relative to the female adapter 12 and the cap 52 is freely rotatable relative to the case 20. Without access to the first blocker tool 28 and the second blocker tool 48, the end-user cannot remove the female adapter from the terminal 14.

The terminator locking cover is removable by reversing the steps of operation described hereinabove.

Figure 2:
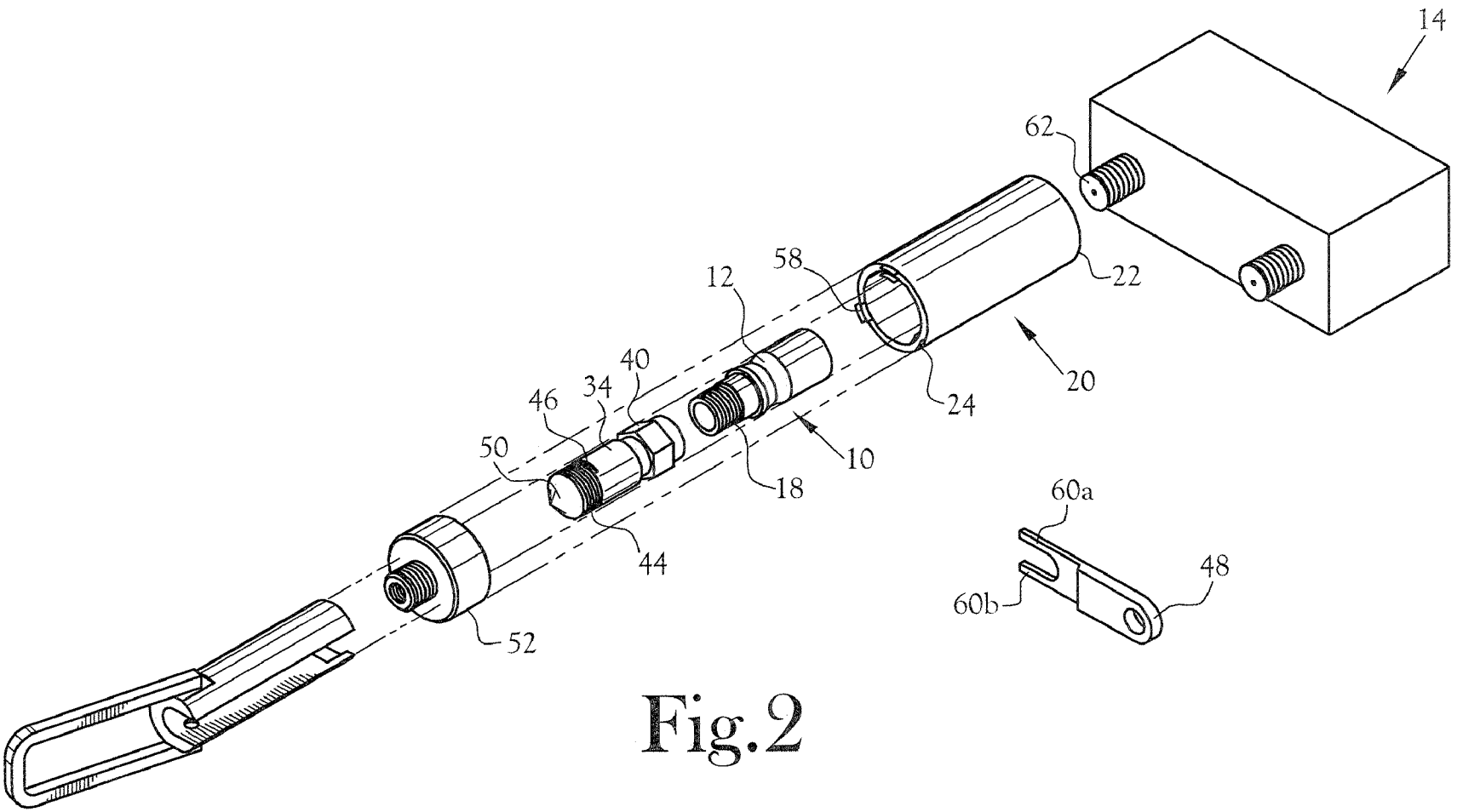
FIG. 2 is an exploded perspective view of the embodiment shown in FIG. 1.
Figure 3:
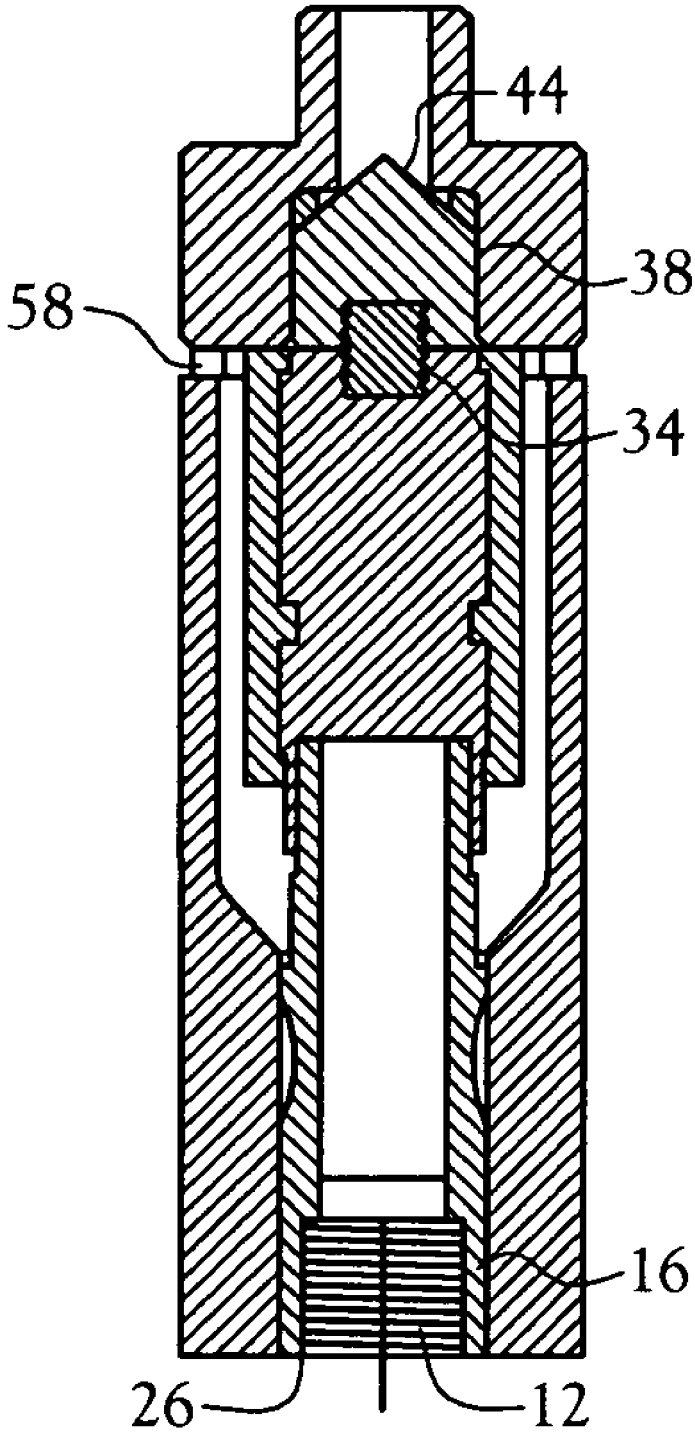
FIG. 3 is a sectional elevation view of the embodiment shown in FIG. 1.
Figure 4:
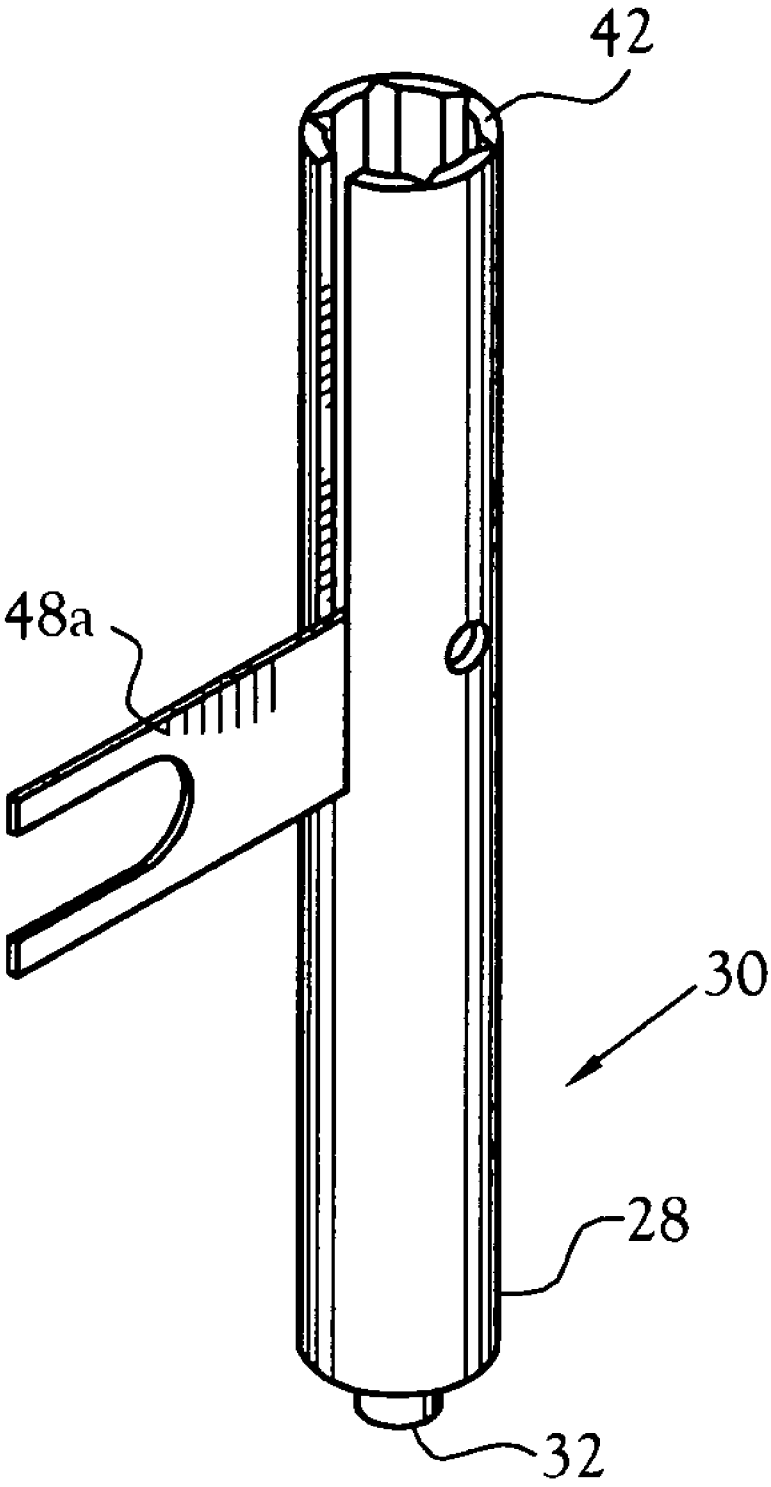
FIG. 4 is a perspective view of a combination tool for assembling and dismantling a terminator lock.
Figure 5:
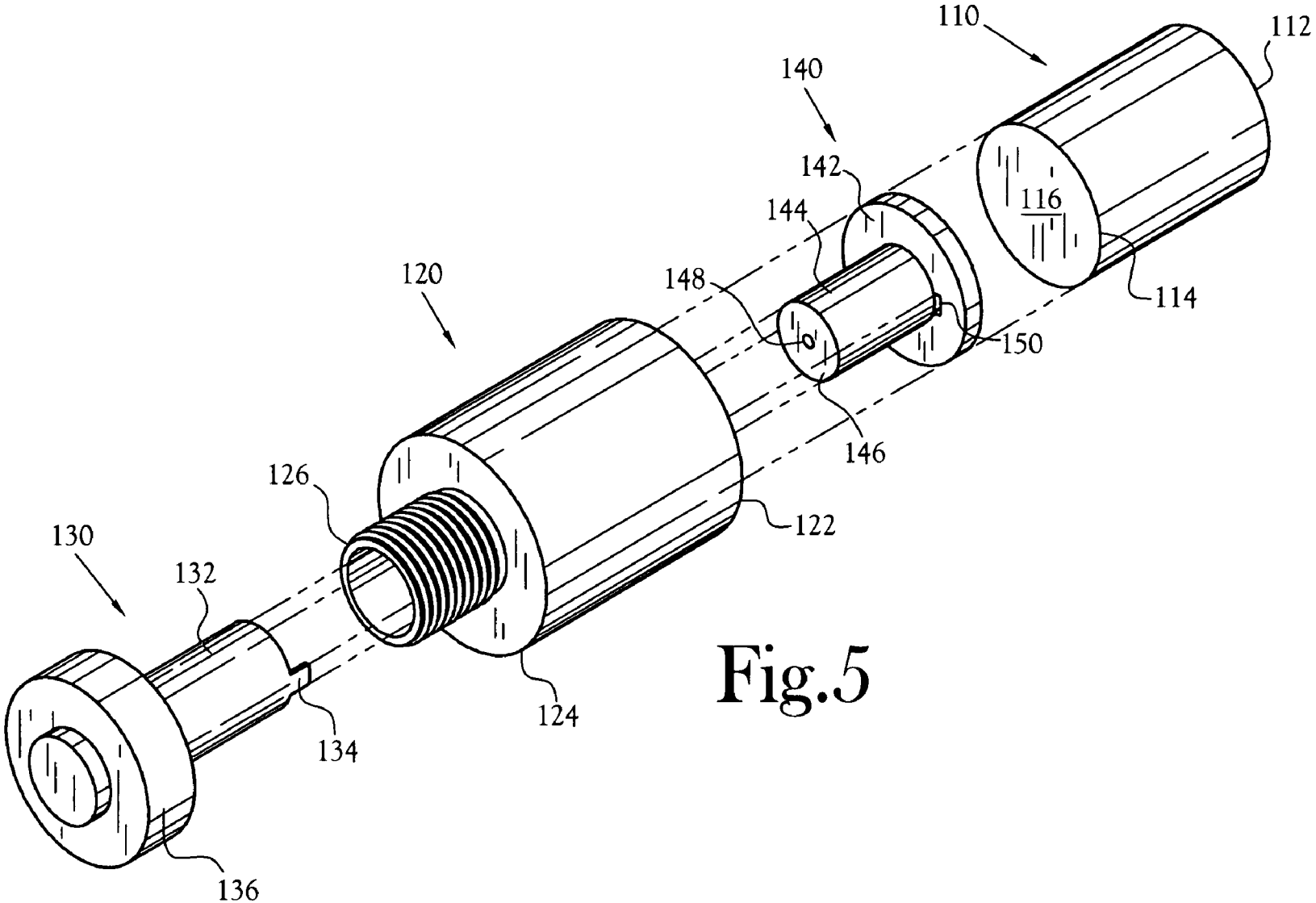
FIG. 5 is an exploded perspective view of another embodiment of a terminator locking system in accordance with the present invention.
Figure 6:
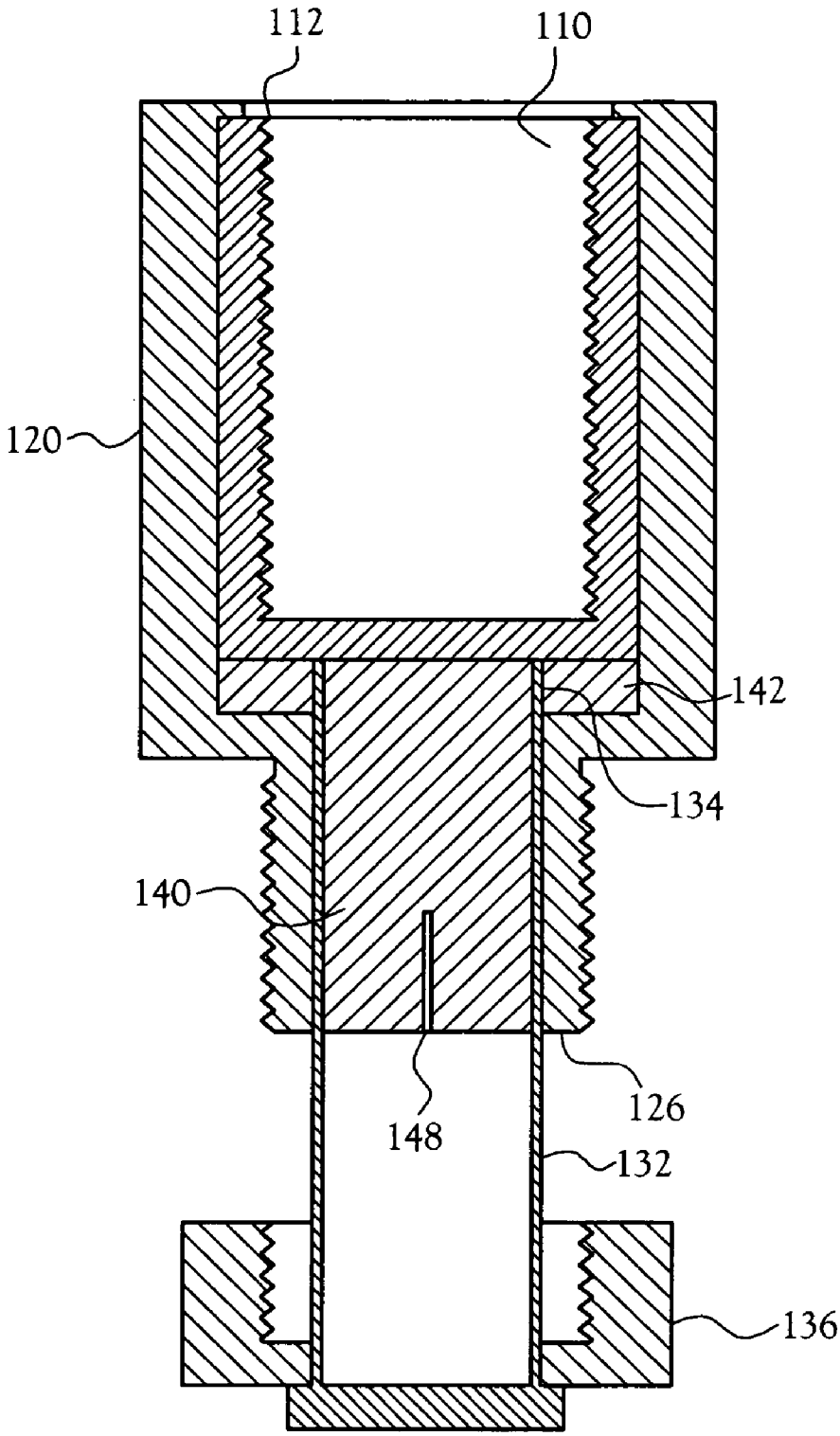
FIG. 6 is a sectional elevation view of the embodiment shown in FIG. 5.

Referring to the embodiment depicted in FIGS. 5 and 6, a female threaded resistor adapter 110 adapted for mating engagement with a male connector 62, as depicted in FIG. 2, is coaxially and rotatably mounted within an elongated tubular case 120 having an inner diameter. The adapter 110 includes a connection end 112 and an engagement end 114. The engagement end 114 includes an engagement surface 116. The tubular case 120 includes a connection end section 122 and a protection end section 124. The protection end section 124 includes a coaxial extension 126 having a threaded outer surface. The extension 126 is adapted to matingly engage the threaded connector of a standard cable. The adapter 110 is captured within the case 120 so that when the adapter 110 is fully engaged with the connector 62 it is fully surrounded by the case 120. Preferably, the tubular case 120 is constructed from hardened steel to prevent easy destruction of the case 120, by cutting, for example.

A blocker 140, comprising a disk 142 and a coaxial stem 144 extending from the disk 142 to a distal end 146, is mounted within the case 120, between the adapter 110 and the protection end section 124. The blocker 140 may be fixed within the case 120 or rotatable within the case 120. The disk 142 defines at least one aperture 150 which extends through the thickness of the disk 142 to permit contact with the engagement surface 116. A cavity 148, coaxially defined within the stem 144 adjacent to the distal end 146, is adapted to receive the central wire of a cable.

The stem 144 has an outer diameter which is less than the inner diameter of the extension 123 to define a peripheral cylindrical gap between the stem 144 and the extension 126.

A tool 130 is adapted for selective attachment to the case 120 and engagement with the adapter 110 to prevent rotation of the adapter 110 relative to the case 120 and thus allow attachment and removal of the adapter 110 from the connector 62. The tool 130 comprises an elongated tubular insertion section 132 having an engagement end section 134 defining a lug and an opposing handle end section 136. The thickness of the wall of the insertion section 132 is adapted to slide between the stem 144 and the extension 126 and allow the lug of the engagement end section to extend through the aperture 150 to engage the surface 116.

The handle end 136 defines a female threaded surface adapted to matingly engage the male threaded surface of the extension 126 for selective attachment of the tool 130 to the case 120.

In operation, the engagement end section 134 is inserted into the case 120, between the stem 144 and the extension 126 until the lug of the end section 134 extends through the aperture 150 to engage the engagement surface 116 of the adapter 110. Then the handle 136 is threaded tightly onto the extension 126 attach the tool 130 to the case 120 and to create frictional engagement of the engagement end section 134 of tool 130 with the engagement surface 116 of the adapter 110. At this point, the adapter is tightly threaded onto the connector 62. The handle 136 is then unthreaded from the extension 126 and the engagement end section 134 is withdrawn from the case 120. The adapter 110 is then secured to the connector 62 and the case 120 is freely rotatable relative to the adapter.

The terminator locking cover is removable by reversing the steps of operation described hereinabove.

Figure 7:
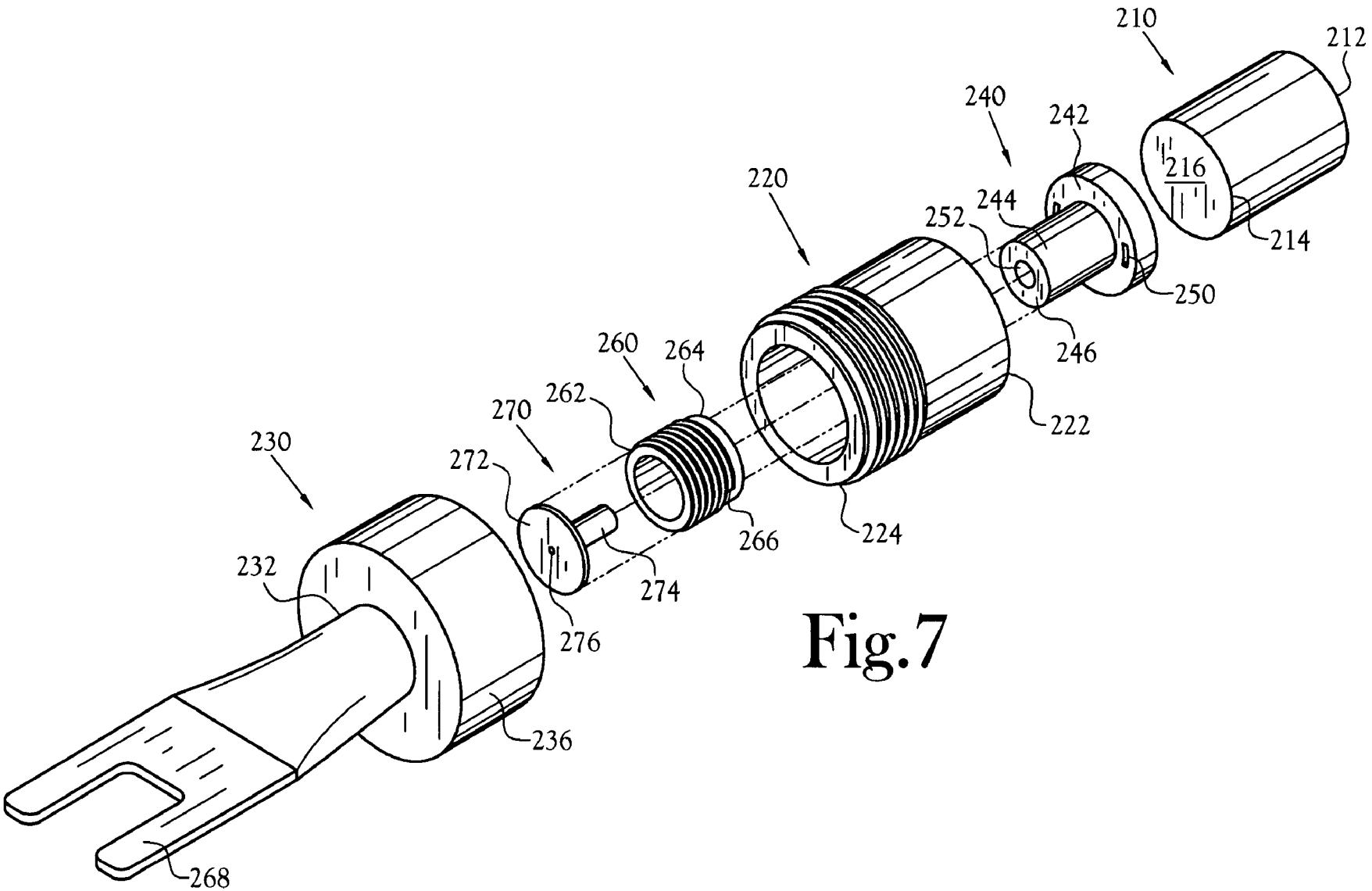
FIG. 7 is an exploded perspective view of an additional embodiment of a terminator locking system in accordance with the present invention.
Figure 8:
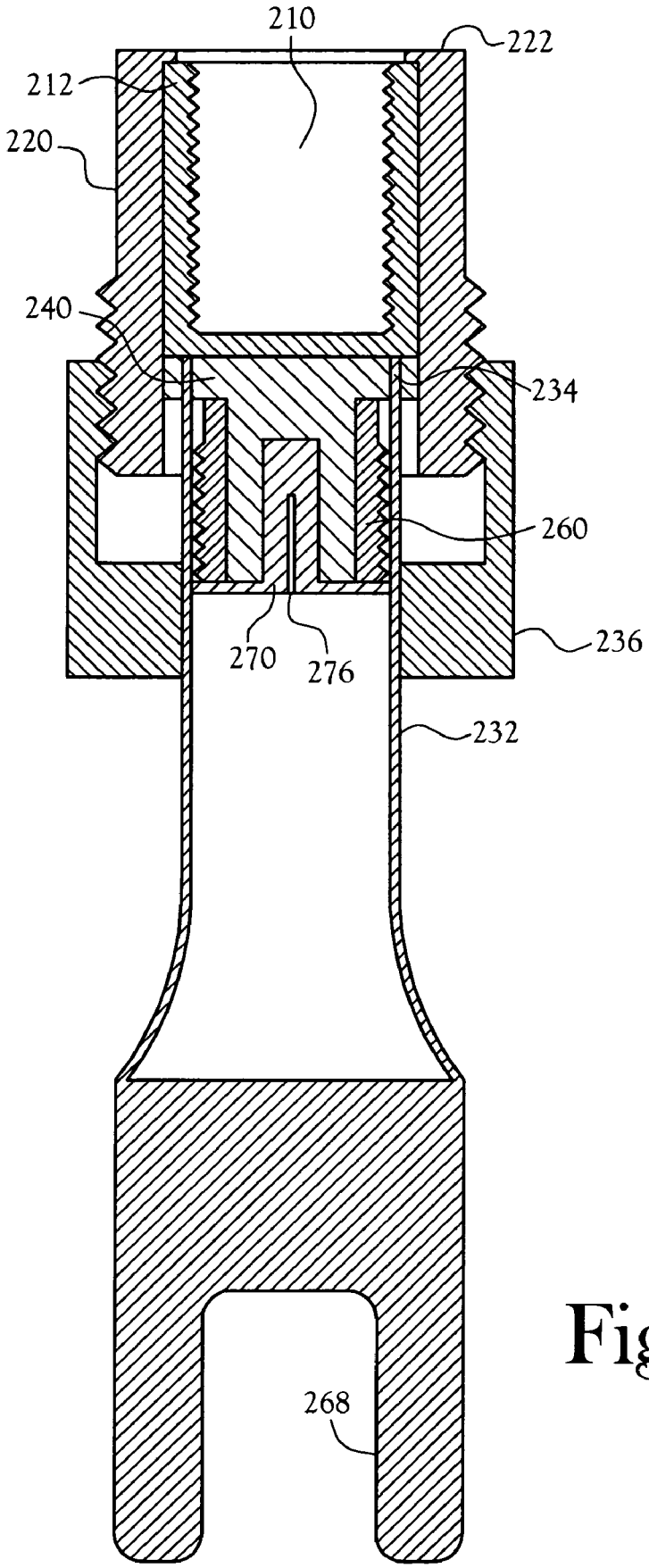
FIG. 8 is a sectional elevation view of the embodiment shown in FIG. 7.

Referring to the embodiment depicted in FIGS. 7 and 8, a female threaded resistor adapter 210 adapted for mating engagement with a male connector 62, as depicted in FIG. 2, is coaxially and rotatably mounted within an elongated tubular case 220 having an inner diameter. The adapter 210 includes a connection end 212 and an engagement end 214. The engagement end 214 includes an engagement surface 216. The tubular case 220 includes a connection end section 222 and a protection end section 224. The protection end section 224 has a threaded outer surface. The adapter 210 is captured within the case 220 so that when the adapter 210 is fully engaged with the connector 62 it is fully surrounded by the case 220. Preferably, the tubular case 220 is constructed from hardened steel to prevent easy destruction of the case 220, by cutting, for example.

A blocker 240, comprising a disk 242 and a coaxial stem 244 extending from the disk 242 to a distal end 46, is mounted within the case 220, between the adapter 210 and the protection end section 224. The blocker 240 may is fixed within the case 220. The disk 242 defines at least one aperture 250 which extends through the thickness of the disk 242 to permit contact with the engagement surface 216. A male-threaded bushing 260, having an outboard end 262 and an opposing inboard end 264 is coaxially and rotatably mounted upon the stem 244. A cavity 252, coaxially defined within the stem 244 adjacent to the distal end 246, is adapted to receive a pin 274 of a cap 270. The cap 270 further comprises a disk 272 having a diameter greater than the diameter of the stem 244, whereby said cap prevents axial movement of the bushing 260 relative to the stem 244. A cavity 276, coaxially defined within the pin 274, is adapted to receive the central wire of a cable.

The bushing 260 has an outer diameter which is less than the inner diameter of the case 220 to define a peripheral cylindrical gap between the bushing 260 and the case 220.

At least one flat 266 is defined on the outer surface of the bushing 260 to create a non-circular engagement surface, whereby a tool may engage said non-circular engagement surface and prevent rotation of the rotatable bushing 260 during attachment or removal of a cable adapted for threaded attachment to said bushing.

A tool 230 is adapted for selective attachment to the case 220 and engagement with the adapter 210 to prevent rotation of the adapter 210 relative to the case 220 and thus allow attachment and removal of the adapter 210 from the connector 62. The tool 230 comprises an elongated tubular insertion section 232 having an engagement end section 234 defining a lug and a handle section 236. The thickness of the wall of the insertion section 232 is adapted to slide within the peripheral cylindrical gap between the bushing 260 and the case 220 and allow the lug of the engagement end section 234 to extend through the aperture 250 to engage the surface 216.

The handle section 236 defines a female threaded surface adapted to matingly engage the male threaded surface of the case 220 for selective attachment of the tool 230 to the case 220.

In operation, the engagement end section 234 is inserted into peripheral gap between the case 220 and the bushing 260 until the lug of the end section 234 extends through the aperture 250 to engage the engagement surface 216 of the adapter 210. Then the handle 236 is threaded tightly onto the case 220 to attach the tool 230 to the case 220 and to create frictional engagement of the engagement end section 234 of tool 230 with the engagement surface 216 of the adapter 210. At this point, the adapter 210 is tightly threaded onto the connector 62. The handle 236 is then unthreaded from the case 220 and the engagement end section 234 is withdrawn from the peripheral cylindrical gap between the bushing 260 and the case 220. The adapter 210 is then secured to the connector 62 and the case 120 is freely rotatable relative to the adapter.

In order to attach a cable to the normally rotatable bushing 260, the tool 230 includes two tines 268 adapted to engage flats 266 on the outer surface of the bushing 260 to temporarily restrain rotation of the bushing 260 while the cable is threadably attached to the bushing 260.

The cable and the terminator locking cover are removable by reversing the steps of operation described hereinabove.

Those skilled in the art will recognize that various modifications of the system can be used without departing from the spirit and scope of the present invention.

From the foregoing description, it will be recognized by those skilled in the art that an improved terminal locking system has been provided.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A terminal locking system comprising:

an elongated tubular case having a connection end section and an opposing distal end section, an adapter, configured to matingly engage a terminal, rotatably mounted within said connection end section and including an engagement surface located within said case, and a blocker, comprising a disk having at least one aperture extending through said disk, mounted within said tubular case between said engagement surface and said distal end, and a tool adapted for selective attachment to said case and insertion through said at least one aperture to engage said engagement surface of said adapter, whereby, when said tool is attached to said case and engaged with said engagement surface, said adapter, said case and said tool rotate as one to permit attachment or removal of said adapter from said terminal.

2. The apparatus of claim 1 wherein said tool comprises an elongated tubular section including an engagement end and an opposing handle end and said engagement end includes a lug adapted to extend through said aperture to engage said engagement surface when said tool is attached to said case.

3. The apparatus of claim 1 wherein said tool includes a threaded surface adapted to threadably engage a threaded surface of said case to provide said selective attachment.

4. The apparatus of claim 1 wherein said blocker includes a coaxial stem extending from said disk through at least a portion of said distal end section.

5. The apparatus of claim 4 and further comprising a threaded bushing coaxially and rotatably mounted upon said stem.

6. The apparatus of claim 5 and further comprising a tool adapted for selective attachment to said case and insertion through said at least one aperture to engage said engagement surface of said adapter, whereby, when said tool is attached to said case and engaged with said engagement surface, said adapter, said case and said tool rotate as one to permit attachment or removal of said adapter from said terminal.

7. The apparatus of claim 6 wherein said tool comprises an elongated tubular section including an engagement end and an opposing handle end and said engagement end includes a lug adapted to extend through said aperture to engage said engagement surface when said tool is attached to said case.

8. The apparatus of claim 6 wherein said tool includes a threaded surface adapted to threadably engage said threaded surface of said bushing to provide said selective attachment.

9. The apparatus of claim 5 and further comprising a cap secured to said stem to prevent axial movement of said bushing along said stem.

10. The apparatus of claim 5 wherein said rotatable bushing includes a non-circular engagement surface, whereby a tool may engage said non-circular engagement surface and prevent rotation of said rotatable bushing during attachment or removal of a cable adapted for threaded attachment to said bushing.

11. The apparatus of claim 1 wherein said blocker is axially rotatable within said case.

12. A tool adapted for selective attachment to a terminator comprising an elongated tubular case having a connection end section and an opposing distal end section, an adapter, configured to matingly engage a terminal, rotatably mounted within said connection end section and including an engagement surface located within said case, and a blocker, comprising a disk having at least one aperture extending through said disk, mounted within said tubular case between said engagement surface and said distal end, said tool comprising:

an elongated tubular section including an engagement end and an opposing handle end and said engagement end includes a lug adapted to extend through said aperture to engage said engagement surface when said tool is attached to said case.

13. The apparatus of claim 12 wherein said tool includes a threaded surface adapted to threadably engage a threaded surface of said case to provide said selective attachment.

* * * * *